US009835023B2

(12) United States Patent
Hallundbæk et al.

(10) Patent No.: US 9,835,023 B2
(45) Date of Patent: Dec. 5, 2017

(54) BARRIER TESTING METHOD

(71) Applicant: WELLTEC A/S, Allerød (DK)

(72) Inventors: Jørgen Hallundbæk, Græsted (DK); Ricardo Reves Vasques, Holte (DK); Paul Hazel, Aberdeen (GB)

(73) Assignee: Welltec A/S, Allerød (DK)

( * ) Notice: Subject to any disclaimer, the term of this patent is extended or adjusted under 35 U.S.C. 154(b) by 296 days.

(21) Appl. No.: 14/439,316

(22) PCT Filed: Oct. 30, 2013

(86) PCT No.: PCT/EP2013/072699

§ 371 (c)(1),
(2) Date: Apr. 29, 2015

(87) PCT Pub. No.: WO2014/067992

PCT Pub. Date: May 8, 2014

(65) Prior Publication Data

US 2015/0300154 A1 Oct. 22, 2015

(30) Foreign Application Priority Data

Oct. 31, 2012 (EP) ..... 12190841

(51) Int. Cl.
*E21B 47/00* (2012.01)
*E21B 33/127* (2006.01)
(Continued)

(52) U.S. Cl.
CPC ..... *E21B 47/0006* (2013.01); *E21B 33/12* (2013.01); *E21B 33/127* (2013.01);
(Continued)

(58) Field of Classification Search
None
See application file for complete search history.

(56) References Cited

U.S. PATENT DOCUMENTS 4,756,364 A * 7/1988 Christensen ..... E21B 34/125 166/101
2005/0028980 A1 2/2005 Page et al.
(Continued)

FOREIGN PATENT DOCUMENTS

CN 101680282 A 3/2010
EP 1 624 152 2/2006
(Continued)

OTHER PUBLICATIONS

International Search Report for PCT/EP2013/072699 dated May 23, 2014, five pages.
(Continued)

*Primary Examiner* — Shane Bomar
(74) *Attorney, Agent, or Firm* — Nixon & Vanderhye P.C.

(57) ABSTRACT

The present invention relates to a barrier testing method for testing a production casing in a borehole (4). The method is applied before initiating production in a well and comprises the steps of connecting a drill pipe (10) with a first end (20) of a first production casing having annular barriers (17), which annular barriers (17) comprise a tubular part forming part of the casing and an expandable sleeve circumferenting the tubular part, thereby defining an expandable space; inserting the drill pipe (10) and the first production casing (3) via a drill head (6) arranged at a top (7) of the well into an intermediate casing (11) extending in a first part (18) of the borehole (4) closest to the top of the well and at least part of the first production casing into a second part (19) of the borehole; sealing a second end (21) of the first production casing (3); pressurizing the first production casing (3) from within and expanding one or more of the expandable sleeves (22) of the annular barriers (17) to abut a wall of the borehole; pressurizing the first production casing (3) from within to a predetermined pressure; and testing the first production casing (3) after expansion by measuring if the
(Continued)

predetermined pressure is kept constant during a predetermined time period. Furthermore, the invention relates to a completion system for oil production from a well and to an oil production facilitated by the method barrier testing method.

16 Claims, 10 Drawing Sheets

(51) Int. Cl.

| | |
|---|---|
| ***E21B 43/10*** | (2006.01) |
| ***E21B 47/10*** | (2012.01) |
| ***E21B 33/12*** | (2006.01) |
| ***E21B 33/14*** | (2006.01) |
| ***E21B 34/06*** | (2006.01) |
| ***E21B 43/25*** | (2006.01) |
| ***E21B 47/06*** | (2012.01) |

(52) U.S. Cl.
CPC ..... *E21B 33/14* (2013.01); *E21B 34/06* (2013.01); *E21B 43/10* (2013.01); *E21B 43/103* (2013.01); *E21B 43/25* (2013.01); *E21B 47/06* (2013.01); *E21B 47/1025* (2013.01)

(56) References Cited

U.S. PATENT DOCUMENTS

2007/0029082 A1* 2/2007 Giroux ..... E21B 33/1208 166/250.01
2011/0011646 A1* 1/2011 Giroux ..... E21B 7/06 175/61
2013/0319677 A1* 12/2013 Hallundb.ae butted.k ..... E21B 33/1285 166/308.1

FOREIGN PATENT DOCUMENTS

| | | | |
|---|---|---|---|
| EP | 2 466 064 | A1 | 6/2012 |
| EP | 2 466 065 | | 6/2012 |
| GB | 2 399 368 | | 9/2004 |
| RU | 2 262 580 | C1 | 10/2005 |
| SU | 1366632 | A1 | 1/1988 |
| WO | WO 99/32756 | | 7/1999 |
| WO | WO 2008/131771 | A2 | 11/2008 |
| WO | WO 2012/080490 | A1 | 6/2012 |

OTHER PUBLICATIONS

Written Opinion of the ISA for PCT/EP2013/072699 dated May 23, 2014, six pages.
Notification Concerning Transmittal of Copy of International Preliminary Report on Patentability (Chapter I of the Patent Cooperation Treaty dated May 14, 2015 in International Application No. PCT/EP2013/072699 (8 pages).
Notification of the First Office Action dated Jun. 1, 2017 in Chinese Application No. 201380056763.1, with English Translation (14 pages).
Office Action of Substantive Examination dated Jun. 8, 2017 in Russian Application No. 2015120086/03(031050), with English Translation (12 pages).

* cited by examiner

BARRIER TESTING METHOD

This application is the U.S. national phase of International Application No. PCT/EP2013/072699 filed 30 Oct. 2013 which designated the U.S. and claims priority to EP Patent Application No. 12190841.2 filed 31 Oct. 2012, the entire contents of each of which are hereby incorporated by reference.

FIELD OF THE INVENTION

The present invention relates to a barrier testing method for testing a production casing in a borehole. Furthermore, the invention relates to a completion system for oil production from a well and to an oil production facilitated by the method barrier testing method.

BACKGROUND ART

The Deepwater Horizon oil spill, also referred to as the oil spill in the Gulf of Mexico oil or the Macondo blowout, is an oil spill which flowed unabated for three months in 2010. This blowout is considered one of the largest accidental marine oil spills in the history of the petroleum industry, and the spill stemmed from a sea-floor oil gush that resulted from the 20 Apr. 2010 explosion of the Deepwater Horizon rig which drilled on the Macondo Prospect. It is guessed that one of the primary reasons for the cause of the blowout is a defective cement job during completion of the well. Cement is used to seal between a first tubular and a borehole wall and between the first tubular and the next tubular. The cement is injected, and for some reason, the cement settles in the intended space, and during this process, unwanted pockets are formed in the cement or the cement disappears in an unexpected fracture in the formation. If the cement does not sufficiently fill the annular space, e.g. between the first tubular and the borehole wall, the oil may leak during production and gush through the cement or along the tubular, and an oil spill disaster may be the next step.

After the Macondo blowout, ensuring well integrity has been an increased focus of governments around the world, and thus also of the oil industry. To this effect, the downhole barrier systems incorporated in the well completion designs have been brought into focus to improve the well integrity.

SUMMARY OF THE INVENTION

It is an object of the present invention to wholly or partly overcome the above disadvantages and drawbacks of the prior art. More specifically, it is an object to provide an improved barrier testing method of barriers to be applied in a completion before initiating production in a well.

The above objects, together with numerous other objects, advantages, and features, which will become evident from the below description, are accomplished by a solution in accordance with the present invention by a barrier testing method for testing a production casing in a borehole, the method being applied before initiating production in a well, and the method comprising the steps of:

connecting a drill pipe with a first end of a first production casing having annular barriers, which annular barriers comprise a tubular part forming part of the casing and an expandable sleeve circumferenting the tubular part, thereby defining an expandable space, inserting the drill pipe and the first production casing via a drill head arranged at a top of the well into an intermediate casing extending in a first part of the borehole closest to the top of the well and at least part of the first production casing into a second part of the borehole, sealing a second end of the first production casing, pressurising the first production casing from within and expanding one or more of the expandable sleeves of the annular barriers to abut a wall of the borehole, pressurising the first production casing from within to a predetermined pressure, and testing the first production casing after expansion by measuring if the predetermined pressure is kept constant during a predetermined time period.

In an embodiment, the barrier testing method may further comprise the steps of setting a first barrier packer between the first production casing and the intermediate casing; disconnecting the drill pipe; pressurising the first production casing and the intermediate casing from within to a second predetermined pressure; and testing the first barrier packer by measuring if the second predetermined pressure is kept constant during a predetermined time period.

Furthermore, the barrier testing method may further comprise the steps of setting a first barrier packer between the first production casing and the intermediate casing; pressurising the intermediate casing from within to a second predetermined pressure; and testing the first barrier packer by measuring if the second predetermined pressure is kept constant during a predetermined time period.

In addition, the barrier testing method may further comprise the steps of inserting a second production casing into the well, the second production casing having a plug arranged within the second production casing and a downhole safety valve arranged within the second production casing closer to the top of the well than the plug; setting a second barrier packer in an annular space between the second production casing and the intermediate casing; pressurising the annular space from within to a third predetermined pressure; and testing the second barrier packer by measuring if the third predetermined pressure is kept constant during a predetermined time period.

Moreover, the barrier testing method may further comprise the steps of opening the downhole safety valve, pressurising the second production casing from within to a fourth predetermined pressure; and testing the plug by measuring if the fourth predetermined pressure is kept constant during a predetermined time period.

Additionally, the barrier testing method may further comprise the steps of closing the downhole safety valve, pressurising the second production casing above the downhole safety valve from within to a fifth predetermined pressure; and testing the downhole safety valve by measuring if the fifth predetermined pressure is kept constant during a predetermined time period.

Further, the barrier testing method may further comprise the steps of replacing the drill head with a well head, pressurising the annular space from within to a sixth predetermined pressure; and testing the second barrier packer by measuring if the sixth predetermined pressure is kept constant during a predetermined time period.

The third and sixth predetermined pressures may be identical.

Also, the barrier testing method may comprise further the steps of pressurising the second production casing above the downhole safety valve from within to a seventh predetermined pressure, and testing the downhole safety valve by measuring if the seventh predetermined pressure is kept constant during a predetermined time period.

In an embodiment, cement is provided between the intermediate casing and the borehole and the intermediate casing comprises at least two annular barriers, and before the first production casing is arranged in the well, the annular barriers of the intermediate casing are expanded to abut the wall of the borehole, thereby displacing the non-cured cement so that a pressure increase is created between the annular barriers, the method comprising the step of testing the annular barriers by monitoring the pressure increase for a period of time.

Furthermore, the intermediate casing may comprise an annular barrier, and before the first production casing is arranged in the well, the annular barriers of the intermediate casing are expanded to abut a second intermediate casing arranged outside the intermediate casing, whereby a second annular space is provided above and between the intermediate barriers and the second intermediate barrier, the method comprising the steps of pressurising the second annular space from within to an eight predetermined pressure, and testing the annular barrier by measuring if the eight predetermined pressure is kept constant during a predetermined time period.

The barrier testing method may further comprise the step of rotating the first production casing while inserting the same.

Moreover, the second end of the first production casing may comprise exterior edges adapted to function as a "drill head" during the insertion of the production casing into the second part of the borehole.

In addition, before the step of sealing the second end of the first production casing is initiated, the first production casing may be pressurised with a flushing fluid so that the flushing fluid is injected from the second end of the first production casing for flushing drilling mud outside the first production casing.

Furthermore, the flushing fluid may be any kind of fluid, such as well fluid, water or sea water.

In an embodiment of the barrier testing method the step of pressurising may be performed by pressurising fluid into the well from the top of the well.

Also, the step of sealing the second end of the first production casing may be performed by dropping a ball into the first production casing, the ball being adapted to seal off an opening provided at the second end of the first production casing.

Additionally, the step of sealing the second end of the first production casing may be performed by inserting a plug into the opening at the second end of the first production casing.

The barrier testing method may further comprise the step of removing the plug arranged in the second production casing.

Moreover, the barrier testing method may further comprise the step of providing apertures in the first production casing to allow fluid communication between the borehole and the casing.

In addition, the apertures may be provided by punching, drilling, pulling, sliding sleeves, perforating the first production casing or a combination thereof.

Also, the expandable sleeve may be made of metal.

Further, the tubular part of the annular barrier may comprise an opening.

Additionally, the intermediate casing and the first and second production casings may be made of metal.

In an embodiment, the barrier testing method may further comprise the step of injecting stimulation fluid out through the apertures into the borehole to perform stimulation of the borehole.

Moreover, the stimulation fluid may be an acid.

Furthermore, the barrier packer may be an expandable annular barrier.

In addition, the drill pipe may be connected with the first production casing by means of a running tool.

Also, the plug may be a glass plug or a formation isolation valve (FIV).

The barrier testing method may further comprise the steps of storing data from the testing of the first production casing, the first barrier packer, the second barrier packer, the plug, the downhole safety valve and the annular barriers, respectively, for documenting an overall integrity of the well before oil production.

The present invention furthermore relates to a completion system for oil production from a well, adapted for carrying out the method according to any of the preceding claims.

Finally, the present invention relates to an oil production facilitated by the method described above.

BRIEF DESCRIPTION OF THE DRAWINGS

The invention and its many advantages will be described in more detail below with reference to the accompanying schematic drawings, which for the purpose of illustration show some non-limiting embodiments and in which.

All the figures are highly schematic and not necessarily to scale, and they show only those parts which are necessary in order to elucidate the invention, other parts being omitted or merely suggested.

DETAILED DESCRIPTION OF THE INVENTION

Figure 1:
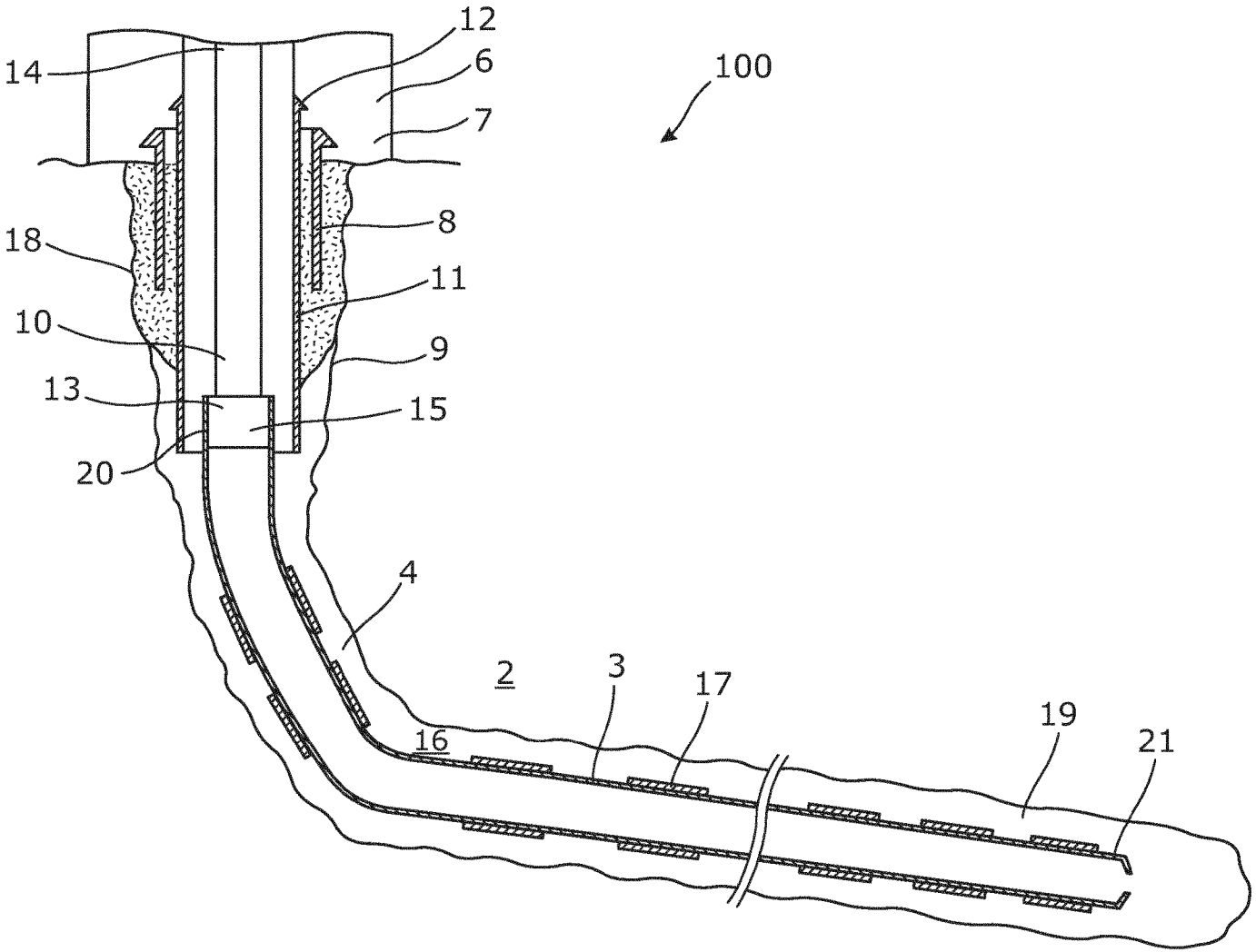
FIG. 1 shows a cross-sectional view of a first production casing being inserted into a borehole of a well.

FIG. 1 shows a completion system 100 being completed. The drill head 6 is arranged at a top 7 of the well in a first part 18 of a borehole 4 and on top of a conductor pipe 8. The conductor pipe 8 is cemented to form a seal against an inner wall 9 of the borehole 4 and is at its top connected with the drill head 6. Inside the conductor pipe 8, an intermediate casing 11 is arranged, still at the top 7 of the well. The intermediate casing 11 is also cemented to form a seal between the conductor pipe 8 and the intermediate casing. The intermediate casing 11 is also at its top end 12 connected with the drill head 6. A drill pipe 10 is connected at a first end 13 with a first end 20 of a first production casing 3. A second end 14 is connected with a pump (not shown) for pressurising the drill pipe 6 and thus the first production casing 3. The production casing 3 and the drill pipe 10 are connected by means of a running tool 15 or a similar connection. The first production casing 3 comprises several annular barriers 17 which in FIG. 1 are unexpanded while being inserted through the drill head 6 down into the intermediate casing 11, and a main part of the first production casing 3 is introduced in a second part 19 of the borehole, forming an annulus 16 with the inner wall 9 of the borehole 4 and thus the formation 2. While inserting the first production casing 3 in the borehole 4, a second end 21 of the first production casing 3 furthest away from the top 7 of the well is open.

Figure 10:
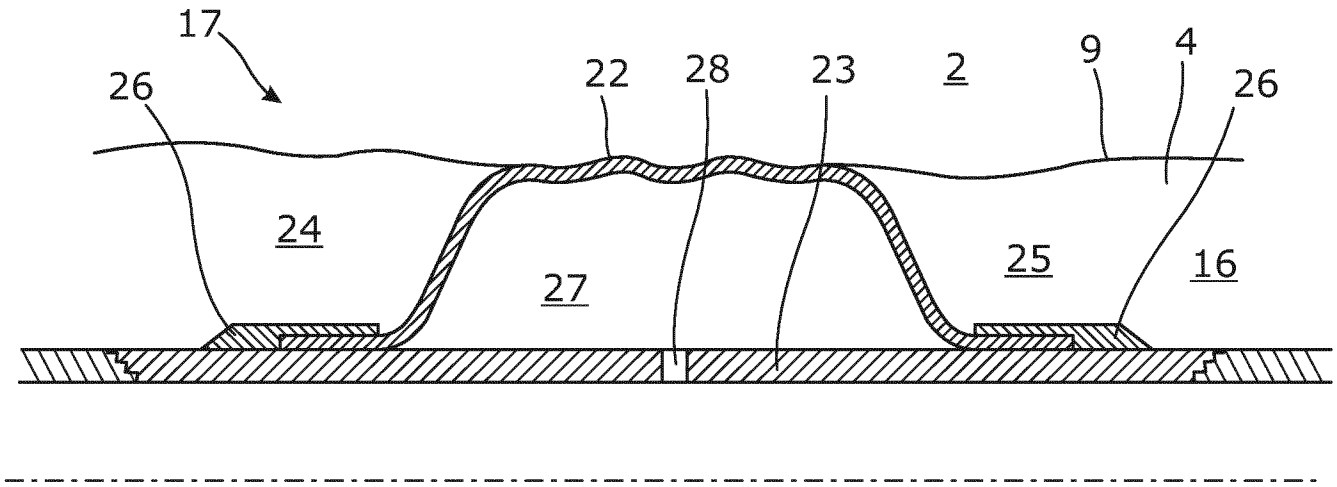
FIG. 10 shows a cross-sectional view of an expanded annular barrier.

Subsequently, the annular barriers 17 are expanded to abut against the inner wall 9 of the borehole 4, as illustrated in FIG. 10. FIG. 10 shows an enlarged view of the annular barrier 17 in its expanded condition, where an expandable sleeve 22 surrounding a tubular part 23 abuts and pressures against the inner wall 9 of the borehole 4. The expanded annular barrier 17 thus creates a seal between the casing and the inner wall 9 of the borehole 4 and divides the annulus 16 into a first production zone 24 and a second production zone 25. The expandable sleeve 22 is connected with the tubular part 23 by means of two connection parts 26 and forms an expandable space 27 into which fluid flows from an inside of the tubular part through an opening 28 and into the space to expand the expandable sleeve 22 and thus the annular barrier 17. The expandable sleeve 22 may be made of metal and have circumferential seals arranged on its outer face.

Figure 2:
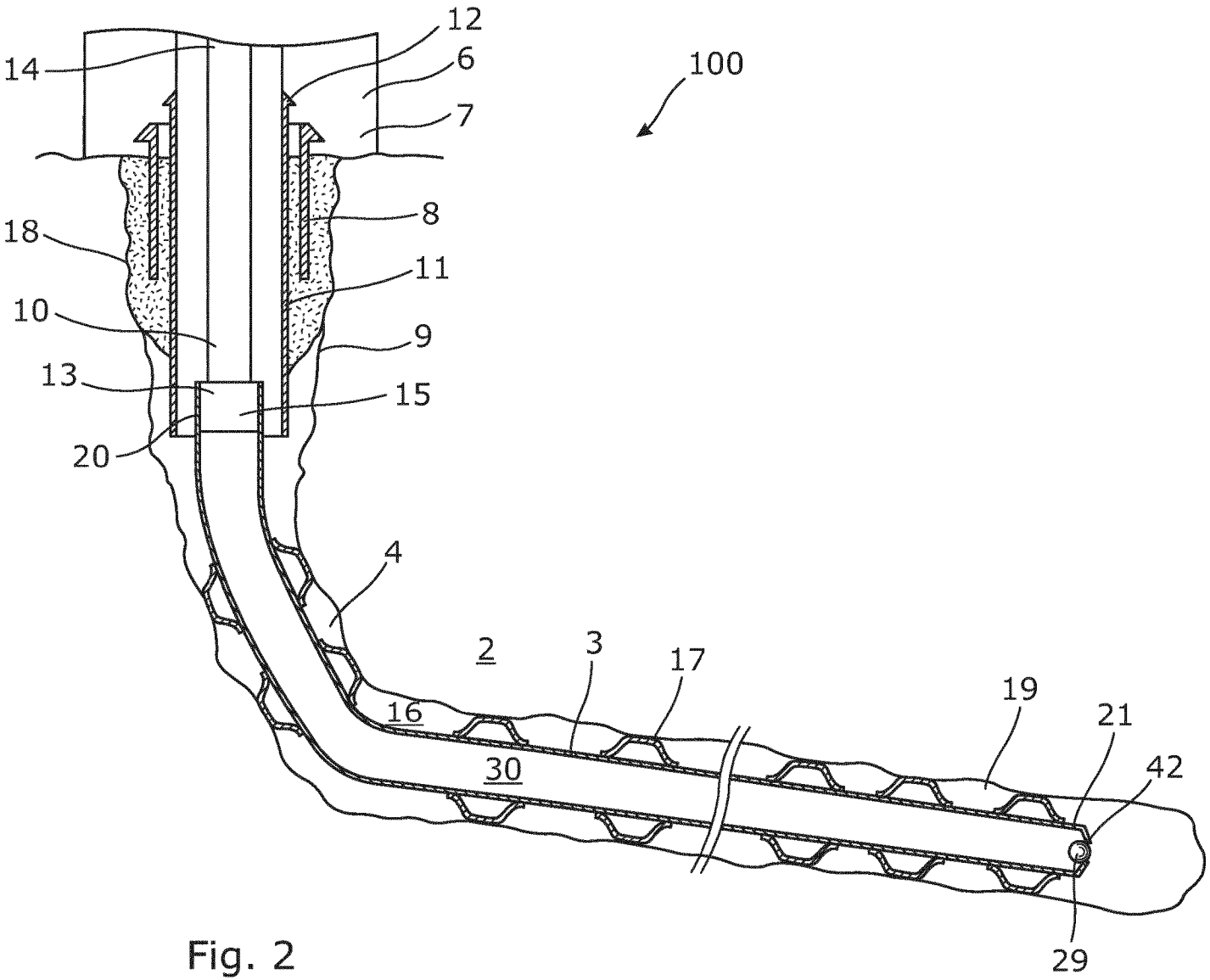
FIG. 2 shows a cross-sectional view of the first production casing having annular barriers being expanded to pressure against a wall of the borehole.

In FIG. 2, the second end 21 of the first production casing 3 is sealed by dropping a ball 29 into the fluid 30 in the drill pipe 10. The ball 29 flows down the well until it seats in a seat 42 arranged in the second end 21 of the first production casing 3. Subsequently, the first production casing 3 and the drill pipe 10 are pressurised from within, creating an increased pressure expanding the expandable annular barriers 17 until they abut the inner wall 9 of the borehole 4 and thus divide the annulus 16 into several production zones. In order to test if the first production casing 3 is still tight when the annular barriers 17 have been expanded, the drill pipe 10 and the first production casing 3 are pressurised to a first predetermined pressure, and the first production casing 3 is tested by measuring if the first predetermined pressure is kept constant during a predetermined time period. If the pressure drops during this time period, it means that the first production casing 3 is leaking, and if the pressure is maintained without having to pump any further, it means that the first production casing 3 is tight and forms a so-called "solid casing", and that it is thus comparable with just a plain metal casing without any implemented components, such as sleeve, barriers or the like.

Figure 3:
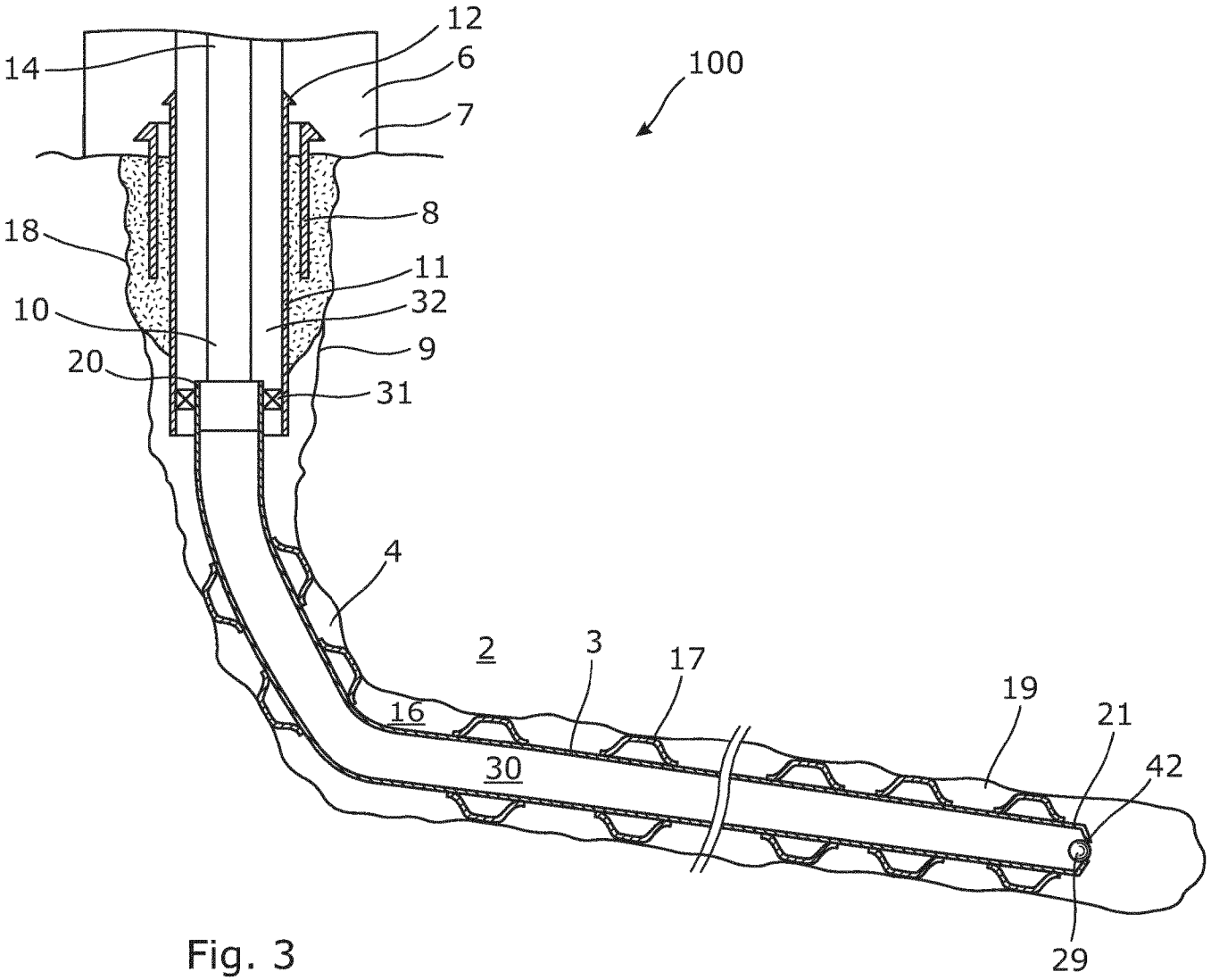
FIG. 3 shows a cross-sectional view of the well in which a first barrier packer has been set between an intermediate casing and the first production casing.

After testing the first production casing 3, the drill pipe 10 must be disconnected, but before doing so, a first barrier packer 31 is set between the first production casing and the intermediate casing 11, as shown in FIG. 3, if it was not already set before testing the first production casing 3. Then, the drill pipe 10 is disconnected and the first production casing 3 and the intermediate casing 11 are pressurised from within to a second predetermined pressure, and the first barrier packer 31 is tested by measuring if the second predetermined pressure is kept constant during a predetermined time period.

In another embodiment, the intermediate casing 11 is pressurised from within to a second predetermined pressure so that the annular space 32 between the intermediate casing 11 and the drill pipe 10 is pressurised to the second predetermined pressure for a period of time, and the first barrier packer 31 is tested by measuring if the second predetermined pressure is kept constant during a predetermined time period.

In known well completion technology, packers and other "barriers" are set, but they are not tested, and it is therefore uncertain whether they are in fact barriers.

Figure 4:
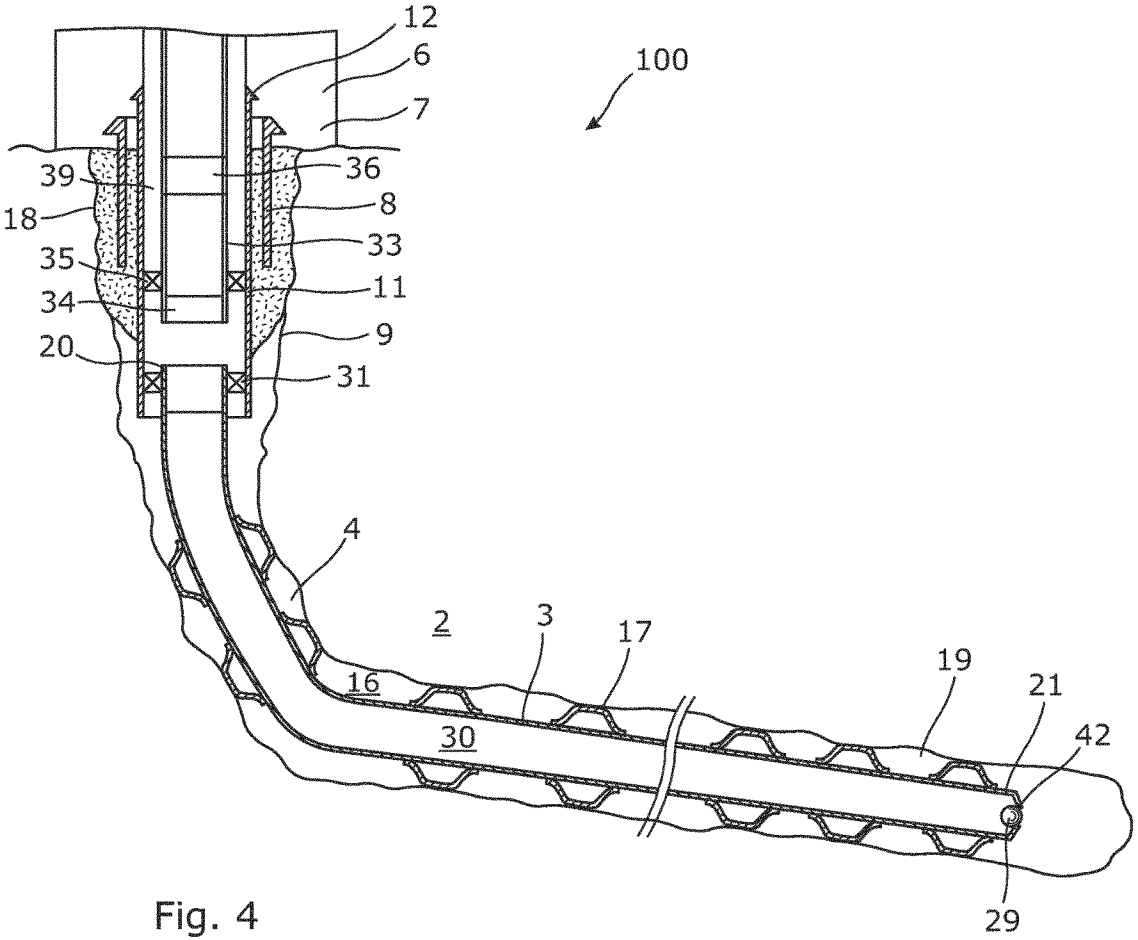
FIG. 4 shows a cross-sectional view of the well in which a second production casing has been installed in the intermediate casing and a second barrier packer has been set between the intermediate casing and the second production casing.

After confirming that the first barrier packer 31 is in fact a barrier, a second production casing 33 having a plug 34 and a downhole safety valve 36 is inserted into the well, as shown in FIG. 4. The plug 34 and the downhole safety valve 36 are both arranged within the second production casing 33, and the downhole safety valve 36 is arranged closer to the top 7 of the well than the plug 34. The downhole safety valve 36 is arranged approximately 200-300 meters down the second production casing from the top of the well. The second production casing 33 is arranged above the first production casing 3 and is thus closer to the top 7 of the well than the first production casing 3. A second barrier packer 35 is subsequently set in an annular space 39 between the second production casing 33 and the intermediate casing 11. In order to test the second barrier packer 35, the annular space 39 is pressurised from within to a third predetermined pressure, and the second barrier packer 35 is tested by measuring if the third predetermined pressure is kept constant during a predetermined time period. The plug 34 may a conventional glass plug or a formation isolation valve, also called a formation isolation valve (FIV).

When it has been confirmed that the second barrier packer 35 is a barrier, the downhole safety valve 36 is opened and the second production casing 33 is pressurised from within to a fourth predetermined pressure, and the plug 34 is tested by measuring if the fourth predetermined pressure is kept constant during a predetermined time period. If the pressure is maintained during the predetermined period of time, it means that the plug 34 is a tight barrier. Subsequently, the downhole safety valve 36 is closed again, and now, five barriers have been tested.

After closing the downhole safety valve 36, the second production casing 33 above the downhole safety valve 36 is pressurised from within to a fifth predetermined pressure, and the downhole safety valve 36 is tested by measuring if the fifth predetermined pressure is kept constant during a predetermined time period and thus if the downhole safety valve 36 is tight and consequently a barrier.

Figure 5:
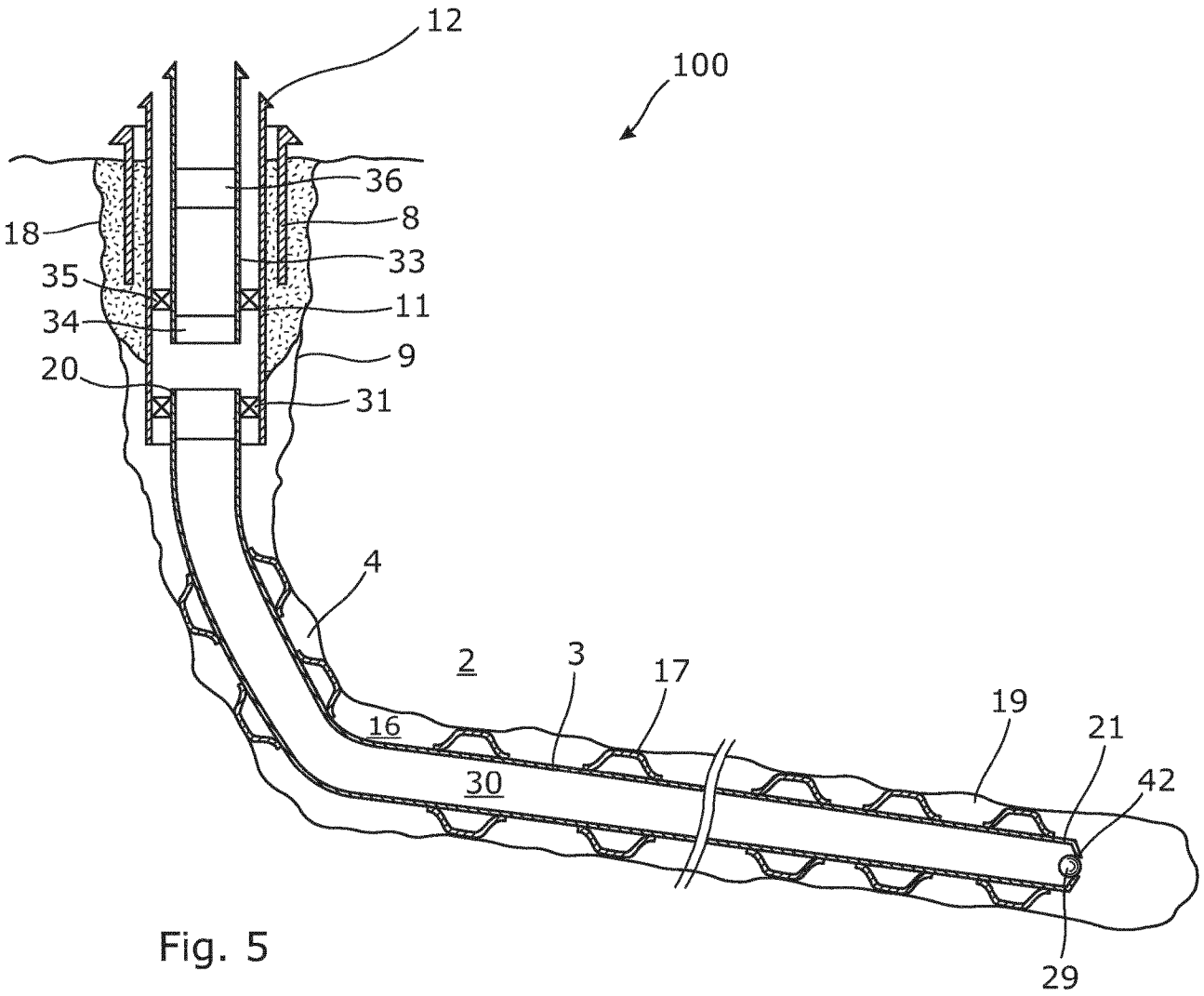
FIG. 5 shows a cross-sectional view of the well in which a drill head at the top of the well has been removed before being replaced with a well head.
Figure 6:
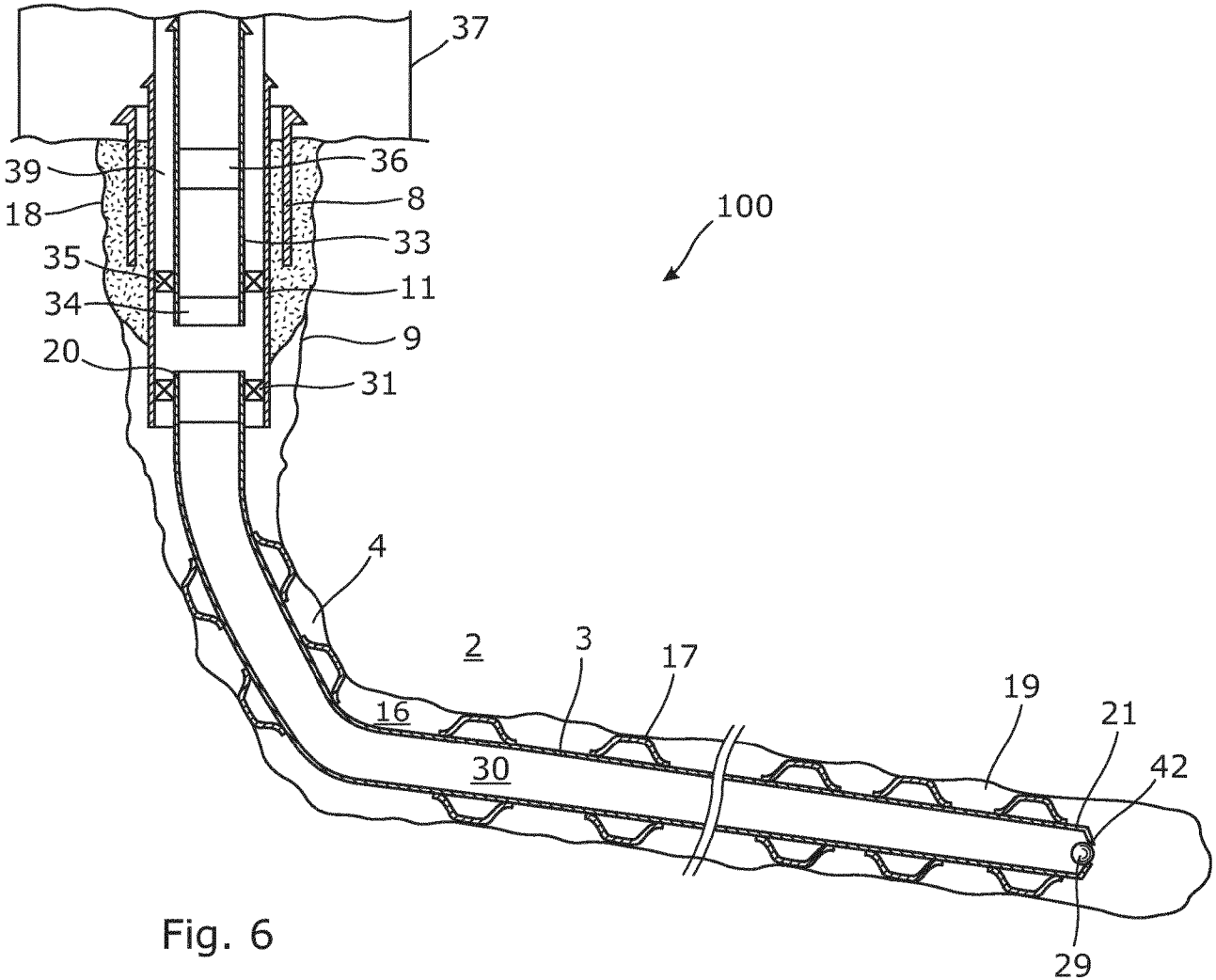
FIG. 6 shows a cross-sectional view of the well in which the drill head has been replaced with the well head.

A downhole safety valve 36 proven to be a barrier closes the well sufficiently to replace the drill head with the well head which is to be used during production, as shown in FIG. 5 where the drill head has been removed. When the well head 37 has been properly connected with the top of the well, as shown in FIG. 6, the annular space 39 between the second production casing 33 and the intermediate casing 11 is pressurised from within to a sixth predetermined pressure, and the second barrier packer 35 is tested again after replacing the drill head. This is done in the same way as described above, i.e. by measuring if the sixth predetermined pressure is kept constant during a predetermined time period, and if the pressure is maintained, it means that the well head 37 has been successfully connected with the intermediate casing 11. Before removing the drill head, the space above the downhole safety valve 36 and/or the plug 34 may be filled with a so-called heavy fluid in order to prevent a blowout. The heavy fluid is subsequently sucked out after having replaced the drill head with the well head 37.

Subsequently, the second production casing 33 above the downhole safety valve 36 is pressurised from within to a seventh predetermined pressure, and the downhole safety valve 36 is tested by measuring if the seventh predetermined pressure is kept constant during a predetermined time period. If both the sixth and the seventh pressure are maintained during the corresponding predetermined period of time, it means that the well head 37 has been successfully connected, as shown in FIG. 6.

Figure 8B:
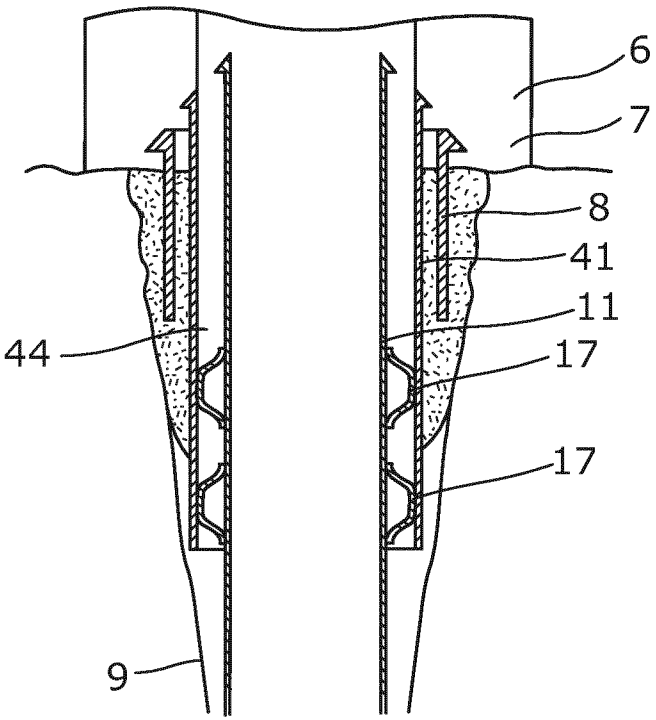
FIG. 8B shows a cross-sectional view of the top of another embodiment of the well in which two annular barriers arranged surrounding a first intermediate casing have been expanded into the surrounding cement in order to provide a well barrier between two intermediate casings.
Figure 8A:
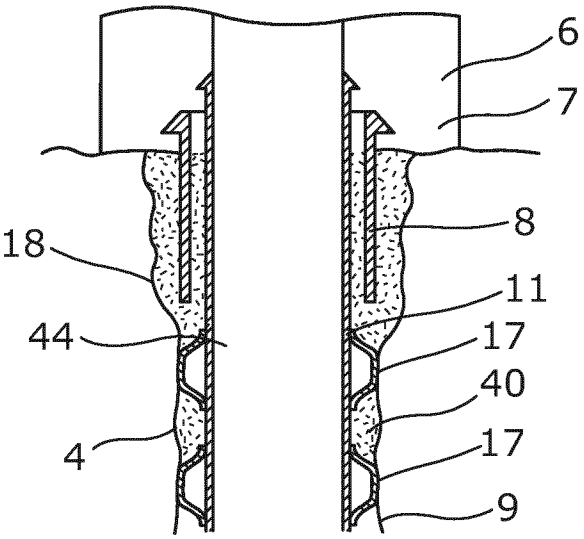
FIG. 8A shows a cross-sectional view of the top of an embodiment of the well in which two annular barriers arranged surrounding the intermediate casing have been expanded into the surrounding cement in order to provide a well barrier.

In FIG. 8A, cement is provided between the intermediate casing 11 and the borehole 4, and in this embodiment, the intermediate casing 11 comprises two annular barriers 17. Before the first production casing is arranged in the well, the annular barriers 17 of the intermediate casing 11 are expanded to abut the inner wall 9 of the borehole 4, displacing the non-cured cement so that a pressure increase is created in the barrier space 40 between the annular barriers 17. To determine if the annular barriers 17 abutting the borehole 4 provide a barrier, the annular space 44 is pressurised from within to an eight predetermined pressure, and the annular barriers 17 are tested by measuring if the eight predetermined pressure is kept constant for a period of time, e.g. by means of a sensor arranged in the barrier space 40. The sensor may subsequently be loaded for information about a tool inserted into the well. By arranging the annular barriers 17 in the cement abutting the borehole, a defective cement job does not jeopardise the well safety since the annular barriers arranged between the intermediate casing 11 and the borehole wall provide a sufficient seal.

At least one annular barrier 17 may also be arranged between the intermediate casing 11 and a second intermediate casing 41. In FIG. 8B, two annular barriers 17 are shown. The barriers 17 are tested by pressurising the annular space 44 between the first intermediate casing 11 and second intermediate casing 41 and monitoring if the pressure drops during a predetermined period of time. In another embodiment, the space below the annular barriers of FIG. 8B is filled with cement.

Figure 7:
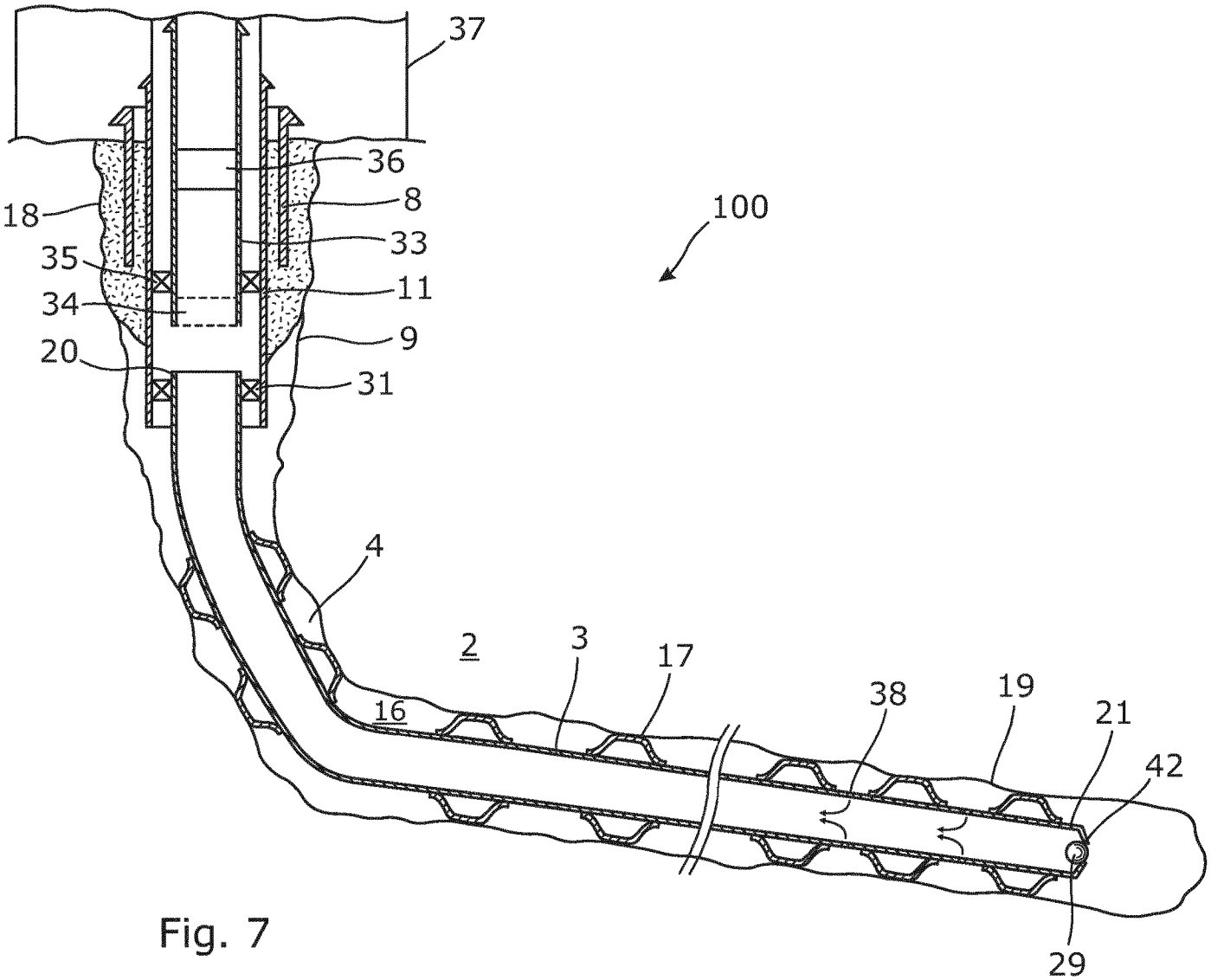
FIG. 7 shows a cross-sectional view of the well in which the first casing has been provided with openings and production of hydrocarbon containing fluid flows through the openings in two production zones between expanded annular barriers.

The well has now been completed and the components and their mutual connections have been tested to confirm that the barriers are in fact barriers, and the well is now ready for initiating production, as shown in FIG. 7. In order to initiate production, the plug 34 arranged in the second production casing 33 is removed. Furthermore, apertures 38 need to be provided in the first production casing 3. The apertures 38 are provided by punching or drilling holes in the wall of the first production casing 3 to provide access from the inside of the casing and the annulus 16. In another embodiment, the first production casing 3 has sliding sleeves (not shown) covering the aperture already present in the casing, and thus, the sliding sleeves need to be activated to provide access to the annulus 16, e.g. by inserting a key tool pulling and sliding the sleeves to its open position. The first production casing 3 may also be perforated by a conventional perforating tool, however, such perforations may injure the barriers tested as described above.

When access has been provided to the annulus 16 and thus the formation, the well may need to be stimulated before being able to produce properly. The stimulation of the well is performed by injecting stimulation fluid out through the apertures 38 and into the borehole 4. The stimulation fluid may be a fracking fluid used to provide fractures in the formation, and the fracking fluid may comprise proppants. The stimulation fluid may also be an acid.

Figure 9:
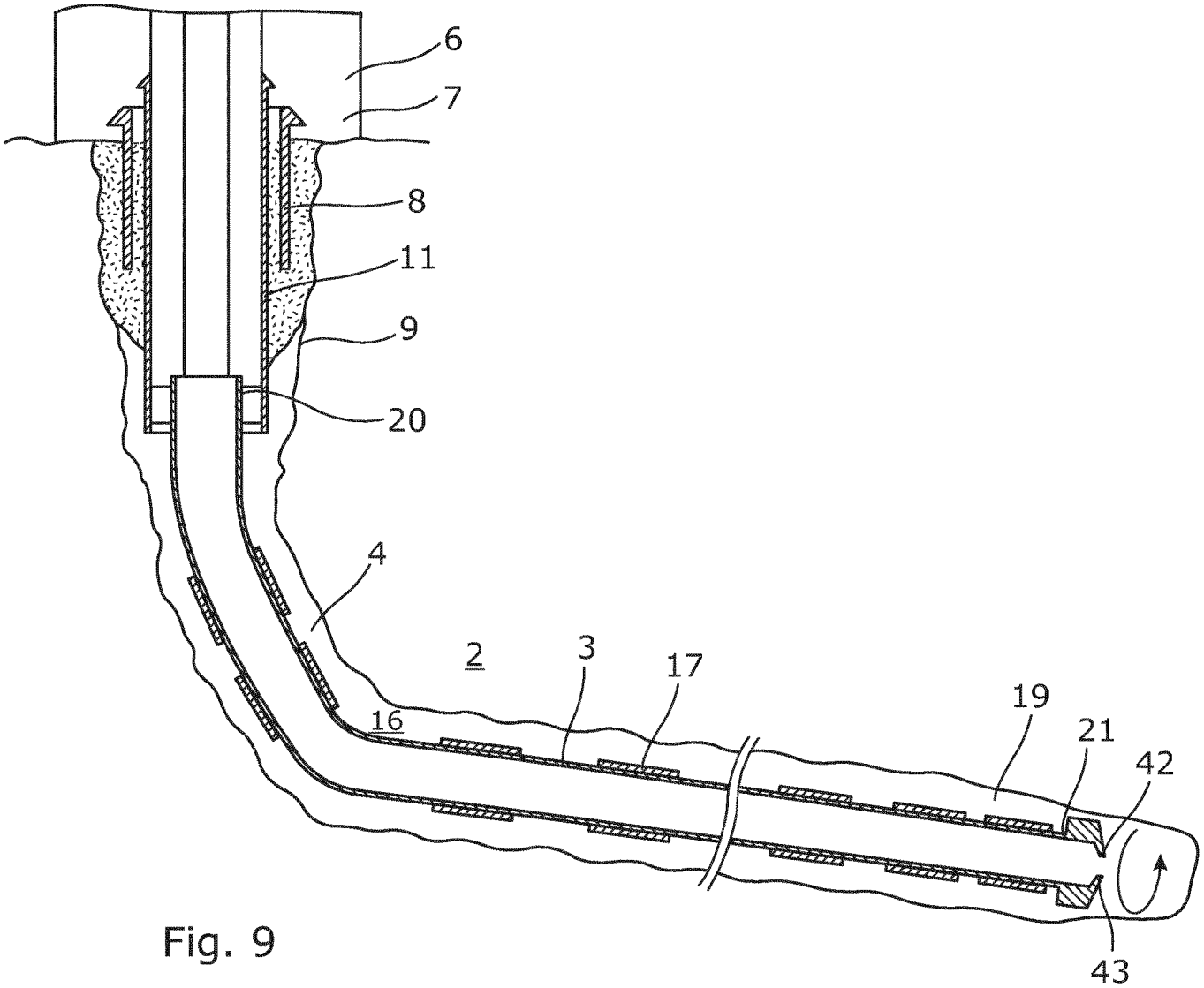
FIG. 9 shows a cross-sectional view of the well, illustrating the first production casing being rotated while being inserted into the borehole.

As shown in FIG. 9, the first production casing 3 may be rotated while inserting the first production casing in order to easily force the casing forward in the borehole 4. Furthermore, the second end 21 of the first production casing 3 comprises exterior edges 43 which are adapted to function as a "drill head" during the insertion of the production casing 3 into the second part 19 of the borehole 4.

Furthermore, the first end 20 of the first production casing 3 may have an enlarged diameter (not shown), enabling the end of the second production casing 33 to fit inside the first end of the first production casing. The end of the second production casing may thus be "snuck-fitted" into the first production casing 3. Having such a fitted connection between the production casings prevents a tool, e.g. a tool connected with a downhole tractor, submerged in later operation from getting stuck in the gap between the two production casings, as shown in FIG. 7.

Before sealing the second end 21 of the first production casing 3, a flushing fluid may be injected from the second end of the first production casing 3 to perform a clean-out by flushing most of the drilling mud outside the first production casing 3 along the outside of the first production casing 3 and along the outside of the drill pipe.

The second end 21 of the first production casing 3 may also be sealed by inserting a plug, such as a swellable plug or another type drop device, into the opening at the second end 21 of the first production casing 3.

The intermediate casing 11 and the first and second production casings 3, 33 are made of metal like the annular barriers 17. The first and/or second barrier packers 31, 35 may be an expandable annular barrier 17.

To document the overall integrity of the well before production, the data obtained during testing of the first production casing 3, the first barrier packer 31, the second barrier packer 35, the plug 34, the downhole safety valve 36 and the annular barriers 17, respectively, are stored.

The well shown in FIG. 7 is thus a completion system 100 obtained by the method described above. The invention also relates to the oil production facilitated by the above method.

By fluid or well fluid is meant any kind of fluid that may be present in oil or gas wells downhole, such as natural gas, oil, oil mud, crude oil, water, etc. By gas is meant any kind of gas composition present in a well, completion, or open hole, and by oil is meant any kind of oil composition, such as crude oil, an oil-containing fluid, etc. Gas, oil, and water fluids may thus all comprise other elements or substances than gas, oil, and/or water, respectively.

By a casing is meant any kind of pipe, tubing, tubular, liner, string etc. used downhole in relation to oil or natural gas production.

In the event that the tool is not submergible all the way into the casing, a downhole tractor can be used to push the tool all the way into position in the well. The downhole tractor may have projectable arms having wheels, wherein the wheels contact the inner surface of the casing for propelling the tractor and the tool forward in the casing. A downhole tractor is any kind of driving tool capable of pushing or pulling tools in a well downhole, such as a Well Tractor®.

Although the invention has been described in the above in connection with preferred embodiments of the invention, it will be evident for a person skilled in the art that several modifications are conceivable without departing from the invention as defined by the following claims.

The invention claimed is:

1. A barrier testing method for testing a production casing in a borehole, the method being applied before initiating production in a well, the method comprising:

connecting a drill pipe with a first end of a first production casing having annular barriers, which annular barriers comprise a tubular part forming part of the casing and an expandable sleeve circumferenting the tubular part, thereby defining an expandable space, inserting the drill pipe and the first production casing via a drill head arranged at a top of the well into an intermediate casing extending in a first part of the borehole closest to the top of the well and at least part of the first production casing into a second part of the borehole, sealing a second end of the first production casing, pressurising the first production casing from within and expanding one or more of the expandable sleeves of the annular barriers to abut a wall of the borehole, pressurising the first production casing from within to a predetermined pressure, and testing the first production casing after expansion by measuring if the predetermined pressure is kept constant during a predetermined time period, while the second end of the first production casing is sealed.

2. A barrier testing method according to claim 1, further comprising:

setting a first barrier packer between the first production casing and the intermediate casing, disconnecting the drill pipe, pressurising the first production casing and the intermediate casing from within to a second predetermined pressure, and testing the first barrier packer by measuring if the second predetermined pressure is kept constant during a predetermined time period.

3. A barrier testing method according to claim 2, further comprising:

inserting a second production casing into the well, the second production casing having a plug arranged within a second production casing and a downhole safety valve arranged within the second production casing closer to the top of the well than the plug, setting a second barrier packer in an annular space between the second production casing and the intermediate casing, pressurising the annular space from within to a third predetermined pressure, and testing the second barrier packer by measuring if the third predetermined pressure is kept constant during a predetermined time period.

4. A barrier testing method according to claim 3, further comprising:

opening the downhole safety valve, pressurising the second production casing from within to a fourth predetermined pressure, and testing the plug by measuring if the fourth predetermined pressure is kept constant during a predetermined time period.

5. A barrier testing method according to claim 4, further comprising:

closing the downhole safety valve, pressurising the second production casing above the downhole safety valve from within to a fifth predetermined pressure, and testing the downhole safety valve by measuring if the fifth predetermined pressure is kept constant during a predetermined time period.

6. A barrier testing method according to claim 5, further comprising:

replacing the drill head with a well head, pressurising the annular space from within to a sixth predetermined pressure, and testing the second barrier packer by measuring if the sixth predetermined pressure is kept constant during a predetermined time period.

7. A barrier testing method according to claim 6, further comprising:

pressurising the second production casing above the downhole safety valve from within to a seventh predetermined pressure, and testing the downhole safety valve by measuring if the seventh predetermined pressure is kept constant during a predetermined time period.

8. A barrier testing method according to claim 1, wherein cement is provided between the intermediate casing and the borehole and the intermediate casing comprises at least two annular barriers, and before the first production casing is arranged in the well, the annular barriers of the intermediate casing are expanded to abut the wall of the borehole, thereby displacing the non-cured cement so that a pressure increase is created between the annular barriers, the method further comprising testing the annular barriers by monitoring the pressure increase for a period of time.

9. A barrier testing method according to claim 7, wherein the intermediate casing comprises an annular barrier, and before the first production casing is arranged in the well, the annular barriers of the intermediate casing are expanded to abut a second intermediate casing arranged outside the intermediate casing, whereby a second annular space is provided above and between the intermediate barriers and the second intermediate barrier, the method comprising:

pressurising the second annular space from within to an eighth predetermined pressure, and testing the annular barrier by measuring if the eighth predetermined pressure is kept constant during a predetermined time period.

10. A barrier testing method according to claim 1, further comprising rotating the first production casing while inserting the same.

11. A barrier testing method according to claim 1, wherein, before sealing the second end of the first production casing is initiated, the first production casing is pressurised with a flushing fluid so that the flushing fluid is injected from the second end of the first production casing for flushing drilling mud outside the first production casing.

12. A barrier testing method according to claim 1, wherein pressurising the first production casing from within to a predetermined pressure is performed by pressurising fluid into the well from the top of the well.

13. A barrier testing method according to claim 1, wherein sealing the second end of the first production casing is performed by dropping a ball into the first production casing, the ball being adapted to seal off an opening provided at the second end of the first production casing.

14. A barrier testing method according to claim 1, further comprising providing apertures in the first production casing to allow fluid communication between the borehole and the casing.

15. A barrier testing method according to claim 14, further comprising injecting stimulation fluid out through the apertures into the borehole to perform stimulation of the borehole.

16. A completion system for oil production from a well, adapted for carrying out the method according to claim 1.

* * * * *